US006325677B1

(12) United States Patent
Tamm

(10) Patent No.: US 6,325,677 B1
(45) Date of Patent: Dec. 4, 2001

(54) CABLE CLAMPING DEVICE

(75) Inventor: Carl R. Tamm, Jonesborough, TN (US)

(73) Assignee: Pan Electric Corporation, Carson City, NV (US)

( * ) Notice: Subject to any disclaimer, the term of this patent is extended or adjusted under 35 U.S.C. 154(b) by 0 days.

(21) Appl. No.: 09/540,640

(22) Filed: Mar. 31, 2000

(51) Int. Cl.[7] ..... H01K 4/40
(52) U.S. Cl. ..... 439/789
(58) Field of Search ..... 439/789

(56) References Cited

U.S. PATENT DOCUMENTS

| | | | | |
|---|---|---|---|---|
| D. 296,777 | | 7/1988 | Cornell . | |
| 3,973,821 | * | 8/1976 | Scott et al. | 439/789 |
| 4,001,921 | * | 1/1977 | Lawlor et al. | 24/132 R |
| 4,357,068 | | 11/1982 | Cornell et al. . | |
| 4,479,694 | | 10/1984 | Cornell et al. . | |
| 4,548,462 | | 10/1985 | Cornell . | |
| 4,898,551 | | 2/1990 | Cornell . | |
| 5,401,194 | | 3/1995 | Cornell . | |
| 5,466,176 | | 11/1995 | Cornell et al. . | |
| 5,765,962 | | 6/1998 | Cornell et al. . | |
| 5,919,065 | * | 7/1999 | Warner et al. | 439/789 |

* cited by examiner

*Primary Examiner*—Gary Paumen
*Assistant Examiner*—Edwin A. León
(74) *Attorney, Agent, or Firm*—Brinks Hofer Gilson & Lione

(57) ABSTRACT

A cable-clamping device includes a second part that is mounted for rotation in a first part. The first part defines a cable-receiving opening, and the second part defines a cable-receiving bore. The opening and the bore define opposed cable-clamping surfaces that clamp a cable therebetween as the second part is rotated in the first part to a closed position. The second cable-clamping surface of the second part is provided with a chamfer that blunts the second cable-clamping surface to reduce any tendency of the clamping device to cut into the clamped cable, while simultaneously enhancing the pull-out resistance.

29 Claims, 1 Drawing Sheet

CABLE CLAMPING DEVICE

BACKGROUND

The present invention relates to cable-clamping devices, and in particular to cable-clamping devices that provide a reduced tendency to cut into the clamped cable as the clamping devices are closed.

U.S. Pat. No. 4,548,462, assigned to the assignee in the present invention, provides a particularly effective and reliable cable-clamping device. As shown in FIG. 5 of this patent, two pairs of opposed clamping surfaces deform the clamped cable to provide a secure mechanical and electrical interconnection between the cable and the cable-clamping device.

Cable-clamping devices of the type shown in U.S. Pat. No. 4,548,462 can on occasion cut into the cable to some extent during the clamping operation. Such cutting of the cable can be objected to by some users, and it therefore would be advantageous if such cutting action could be reduced or avoided.

SUMMARY

By way of introduction, the preferred embodiment described below is a cable-clamping device having two parts, one of which is received in the other for rotation about an axis. The first part defines a cable-receiving opening, and the second part defines a cable-receiving bore. The opening and the bore are aligned when the cable-clamping device is open, and they are misaligned to a selected extent when the device is closed by rotating the second part in the first part. Opposed portions of the opening and bore define respective cable-clamping surfaces, and the cable-clamping surface in the bore of the second part is formed by a chamfer that provides a large cable-clamping area and a blunted edge to the cable-receiving bore. This arrangement has surprisingly been found to improve pull-out resistance of the device while simultaneously reducing any tendency of the clamping-device to cut into the cable clamped in the device.

The foregoing paragraph has been provided by way of introduction, and it is not intended to limit the scope of the following claims.

DETAILED DESCRIPTION OF THE PRESENTLY PREFERRED EMBODIMENTS

Figure 1:
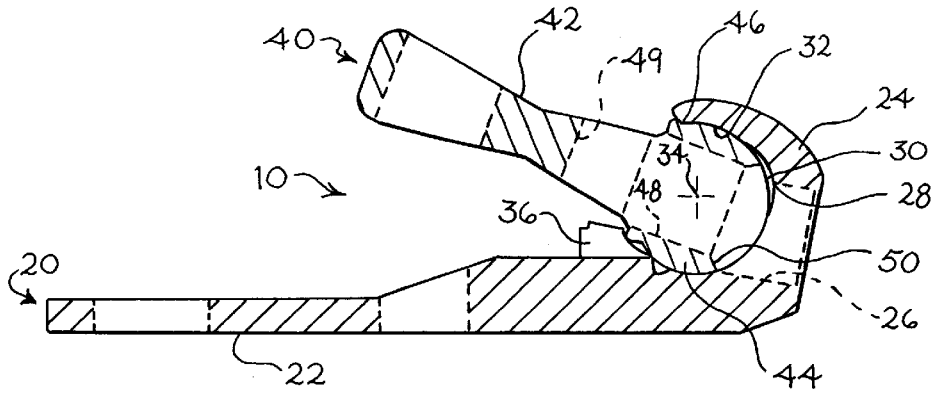
FIGS. 1 and 2 are cross-sectional views showing a cable-clamping device that incorporates a preferred embodiment of this invention in opened and closed positions, respectively.

Turning now to the drawings, FIG. 1 shows a cable-clamping device 10 that is in many ways similar to the cable-clamping device shown in above-referenced U.S. Pat. No. 4,548,462. In particular, the device 10 includes a first member 20 having a first tail 22 and a first head portion 24. The first head portion 24 is generally cylindrical, and defines a cable-receiving opening 26. An interior surface portion of the opening 26 forms a first cable-clamping surface 28, and the first head portion 24 forms a recess 30 inwardly adjacent to the first cable-clamping surface 28. The interior surface

32 of the first head portion 24 is generally cylindrically symmetrical about a rotation axis 34. The first tail 22 includes a protruding element 36.

Figure 4:
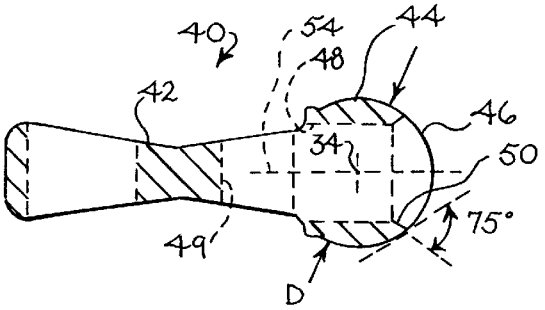
FIG. 4 is a cross-sectional view taken along line 4—4 of FIG. 3.

The device 10 also includes a second member 40 that includes a second tail 42 and a second head portion 44. The second head portion 44 includes a generally cylindrical surface 46 that defines a cylinder diameter D (FIG. 4). A cable-receiving bore 48 extends through the second head portion 44 and into the second tail 42, where it opens out on both sides of the second tail 42 to form a window 49.

The foregoing features of the device 10 may take any desired form, and may be widely adapted depending upon the particular application. For example, these elements can be shaped as described in any of the following U.S. Patents, all assigned to the assignee of the present invention, and all hereby incorporated by reference: U.S. Pat. Nos. D-296,777, 4,357,068, 4,548,462, 4,479,694, 4,898,551, 5,401,194, 5,466,176, 5,765,962, and 5,919,065. Additionally, these elements may be formed as described in the following U.S. provisional patent applications, also assigned to the assignee of the present invention and also incorporated by reference: U.S. patent applications Ser. Nos. 60/164,181, 60/158,012. These documents can be referenced for a more detailed explanation of the manner in which the various elements of the cable-clamping device interact with one another and with the clamped cable.

Depending upon the application, the cable-receiving bore 48 may be skewed with respect to the centerline of the second member 40 such that the clamping action of the clamping device 10 varies depending upon the orientation of the second member 40 in the first member 20. Alternatively, the second member 40 may be made in an asymmetrical form such that it can be assembled with the first member 20 and only a first orientation. Alternatively, the bore 48 may be positioned along the centerline of the second member 40 such that the cable-clamping action is unaffected by the orientation of the second member 40 in the first member 20.

Figure 2:
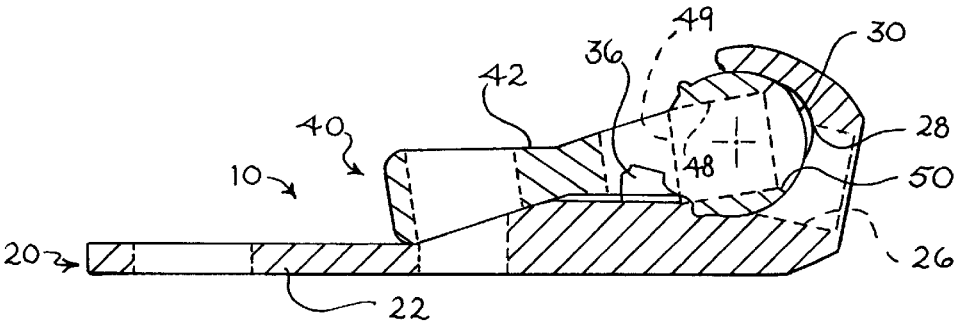

The device 10 includes an improved second cable-clamping surface 50 that is generally opposed to the first cable-clamping surface 28 and is formed by an interior surface portion of the cable-receiving bore 48. When the device 10 is placed in an open, cable-receiving position (FIG. 1), the tails 22, 42 are spaced apart and the bore 48 is axially aligned with the opening 26 to allow a cable to be inserted through the opening 26 and into the bore 48. Once the cable has been fully inserted in the device 10, the device 10 is moved to a closed, cable-clamping position (FIG. 2) by a bolt (not shown) that moves the tails 22, 42 into close proximity to one another. In this position, the bore 48 is misaligned with respect to the cable-receiving opening 26 by a selected amount, thereby causing the first and second cable-clamping surfaces 28, 50 to deform the cable (not shown). The protruding element 36 also deforms the cable in the region of the window 49. In this way, the cable is mechanically secured to the device 10 while simultaneously providing a low-resistance electrical interconnection therebetween.

The recess 30 provides an axial separation between the first and second cable-clamping surfaces 28, 50, thereby providing room for the cable to bend between the cable-clamping surfaces 28, 50. Additionally, the cable-clamping surface 50 is generally frusto-conical in shape and includes a chamfer 52 (FIG. 3) that has the effect of blunting the second cable-clamping surface 50 and directing the sharp edge at the cylindrical surface 46 downwardly, thereby reducing any tendency of the second cable-clamping surface 50 to cut into the cable as the device is moved to the closed position.

Figure 3:
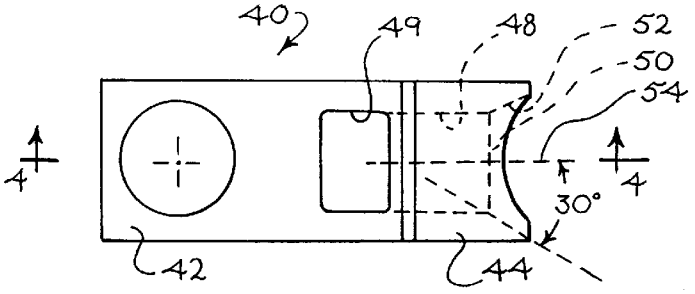
FIG. 3 is a top view of the second member of the embodiment of FIGS. 1 and 2.

In this embodiment, the chamfer 52 extends completely around the bore 48, and the chamfer 52 diverges from the longitudinal bore axis 54 by at least 10°, more preferably by at least 20°, and most preferably by about 30° (FIG. 3).

The chamfer 52 defines an included angle with the cylindrical surface 46, and this included angle, at least in the region of the second cable-clamping surface 50, is preferably greater than 60°, more preferably greater than 70°, and most preferably about 75° (FIG. 4).

The chamfer 52 diverges from the bore 48 at least in the region of the second cable-clamping surface 50, preferably by at least 10°, more preferably by at least 20°, and most preferably by about 30° (FIG. 3). The chamfer 52 diverges from the bore 48 in a region that extends inwardly from the cylindrical surface 46 by more than 1/20 of the diameter D and less than 1/4 of the diameter D. Preferably, the chamfer 52 extends inwardly from the cylindrical surface 46 in the region of the second cable-clamping surface 50 by about 1/10 to 1/7 of the diameter D (FIG. 4).

It is not essential in all embodiments that the chamfer 52 extend completely around the bore 48. For example, the chamfer 52 may be formed only in the region of the second cable-clamping surface 50, i.e., in a region adjacent to a plane that is oriented perpendicular to the rotation axis 34 and passes through the bore axis 54 (i.e. the plane of FIG. 4). Alternatively, when the second member 40 is reversibly mounted in the first member 20, it may be preferable to position the chamfer 52 on both sides of the bore 48 adjacent to this plane. In this way, the chamfer 52 will be properly positioned, regardless of the orientation of the second member 40 in the first member 20.

The chamfer 52 discussed above can be a conventional frusto-conical surface that extends completely around the bore 48 and is oriented at a cone angle of 30° with respect to the bore axis 54. Many other alternatives are possible. For example, the chamfer may include a compound chamfer having an inner region that diverges from the bore axis at a first angle and an outer region that diverges from the bore axis at a second, preferably larger angle. Also, the angle between the chamfer and the bore axis may vary from point to point around the periphery of the bore 48. The chamfer 52 may be formed by a conventional rotary tool, by a controlled mill, or by any other suitable forming process. In some embodiments it may be preferable to substitute a curved outwardly diverging surface for the frusto-conical surfaces described above. Regardless of the precise shape used for the second cable-clamping surface 50, it should preferably be blunted to reduce any tendency of the second cable-clamping surface 50 to cut into the cable as the device 10 is closed.

As used herein, the term "frusto-conical" is intended broadly to encompass frusto-conical surfaces that extend only over a part of the perimeter of a circle. The term "generally cylindrical" is intended broadly to encompass surfaces that extend over only a part of the circumference of a cylinder. The term "position" is intended broadly to encompass a range of positions.

A wide range of materials can be used to form the device 10. Simply by way of example, the first member 20 and the second member 40 can be formed of an aluminum alloy such as 6082-T6, by extruding the basic shapes and forming the various openings, bores, and chamfers described above in secondary machining operations. Preferably, the edge between the cable-receiving opening 26 and the recess 30 in the region 36 is radiused or blunted, as for example by striking it with a punch, in order further to reduce any tendency of the device 10 to cut into the clamped cable.

The device 10 has been found to provide important operational advantages. First, the configuration of the second cable-clamping surface 50 described above has been found to cut into the clamped cable to a lesser extent than similar cable-clamping devices without the chamfer 52. This is particularly noticeable with finely-stranded, aluminum-alloy cable. Surprisingly, the cable-clamping device 10 has proven to provide improved cable pullout resistance as compared to a comparable device without the chamfer 52. Since the area of high-pressure contact is increased between the cable and the member 40 by the chamfer 52, lower resistance and higher current-carrying capacity at a given temperature are expected. Furthermore, the chamfer 52 facilitates introduction of a finely-stranded cable into the bore 48, because the chamfer 52 acts as a funnel.

Of course, it should be understood that many changes and modifications can be made to the preferred embodiment described above. As suggested above, the first and second members 20, 40 can be varied in shape, configuration and proportions in many ways, as long as the basic cable-clamping operations described above are provided. The second cable-clamping surface 50 may be provided with many alternative shapes as discussed above.

The foregoing detailed description has discussed only a few of the many forms that this invention can take. For this reason, this detailed description is intended by way of illustration and not by way of limitation. It is only the following claims, including all equivalents, that are intended to define the scope of this invention.

What is claimed is:

1. A device for clamping a cable comprising:

a first member comprising a first tail portion and a first head portion;

a second member comprising a second tail portion and a generally cylindrical second head portion received within the first head portion for rotation therein about a rotation axis;

said tail portions being spaced apart when said device is in an open, cable-receiving position and in close proximity when said device is in a closed, cable-clamping position;

said first head portion having a cable-receiving opening and said second head portion having a cable-receiving bore, said opening and bore being in general axial alignment when said device is open and in axial misalignment when said device is closed;

said device having a first cable-clamping surface comprising an interior surface portion of said opening and a second cable-damping surface comprising an interior surface portion of one end of said bore;

said cable-receiving bore extending along a bore axis;

said first and second cable-clamping surfaces disposed adjacent a first plane oriented transverse to the rotation axis and including the bore axis;

said second cable-clamping surface oriented to diverge from the bore axis in the first plane by at least 10 degrees to reduce any tendency of the second cable-clamping surface to cut into a cable when said device is moved to the closed, cable-clamping position;

said first cable-clamping surface being blunted near the second head portion at an inner edge of the first cable-clamping surface, thereby reducing any tendency of the first cable-clamping surface to cut into the cable when said device is moved to the closed, cable-clamping position.

2. The invention of claim 1 wherein said second cable-clamping surface is oriented to diverge from the bore axis by at least 20 degrees.

3. The invention of claim 1 wherein said second cable-clamping surface is oriented to diverge from the bore axis by at least 30 degrees.

4. The invention of claim 1 wherein the second cable-clamping surface is substantially frusto-conical in shape.

5. The invention of claim 1 wherein the second head portion defines a cylinder diameter, and wherein the second cable-clamping surface extends over a length parallel to the first plane greater than 1/20 the diameter.

6. The invention of claim 1 wherein the first cable-clamping surface is separated from the second cable-clamping surface by a recess formed in the first head portion.

7. The invention of claim 1 wherein the second cable-clamping surface comprises a chamfer.

8. The invention of claim 1 wherein the first cable-clamping surface is radiused near the second head portion to reduce any tendency of the first cable-clamping surface to cut into the cable.

9. A device for clamping a cable comprising:

a first member comprising a first tail portion and a first head portion;

a second member comprising a second tail portion and a generally cylindrical second head portion received within the first head portion for rotation therein about a rotation axis;

said tail portions being spaced apart when said device is in an open, cable-receiving position and in dose proximity when said device is in a closed, cable-clamping position;

said first head portion having a cable-receiving opening and said second head portion having a cable-receiving bore, said opening and bore being in general axial alignment when said device is open and in axial misalignment when said device is closed;

said device having a first cable-damping surface comprising an interior surface portion of said opening and a second cable-damping surface comprising an interior surface portion of one end of said bore;

said cable-receiving bore extending along a bore axis;

said first and second cable-clamping surfaces disposed adjacent a first plane oriented transverse to the rotation axis and including the bore axis;

said second cable-clamping surface defining with a substantially cylindrical surface of the second head portion an included angle in the first plane, said included angle being greater than 60 degrees;

said first cable-clamping surface being blunted near the second head portion at an inner edge of the first cable-damping surface, thereby reducing any tendency of the first cable-clamping surface to cut into the cable when said device is moved to the dosed, cable-damping position.

10. The invention of claim 9 wherein said included angle is greater than 70 degrees.

11. The invention of claim 9 wherein said included angle is about 75 degrees.

12. The invention of claim 9 wherein the second cable-clamping surface is substantially frusto-conical in shape.

13. The invention of claim 9 wherein the substantially cylindrical surface defines a cylinder diameter, and wherein the second cable-clamping surface extends over a length parallel to the first plane greater than 1/20 the diameter.

14. The invention of claim 9 wherein the first cable-clamping surface is separated from the second cable-clamping surface by a recess formed in the first head portion.

15. The invention of claim 9 wherein the second cable-clamping surface comprises a chamfer.

16. The invention of claim 9 wherein the first cable-clamping surface is radiused near the second head portion to reduce any tendency of the first cable-clamping surface to cut into the cable.

17. A device for clamping a cable comprising:

a first member comprising a first tail portion and a first head portion;

a second member comprising a second tail portion and a generally cylindrical second head portion received within the first head portion for rotation therein about a rotation axis;

said tail portions being spaced apart when said device is in an open, cable-receiving position and in dose proximity when said device is in a closed, cable-clamping position;

said first head portion having a cable-receiving opening and said second head portion having a cable-receiving bore, said opening and bore being in general axial alignment when said device is open and in axial misalignment when said device is closed;

said device having a first cable-clamping surface comprising an interior surface portion of said opening and a second cable-clamping surface comprising an interior surface portion of one end of said bore;

said second cable-clamping surface comprising a chamfer that diverges from the cable-receiving bore by at least 10 degrees;

said first cable-clamping surface being blunted near the second head portion at an inner edge of the first cable-clamping surface, thereby reducing any tendency of the first cable-clamping surface to cut into the cable when said device is moved to the closed, cable-clamping position.

18. The invention of claim 17 wherein the chamfer diverges from the cable-receiving bore by at least 20 degrees.

19. The invention of claim 17 wherein the chamfer diverges from the cable-receiving bore by at least 30 degrees.

20. The invention of claim 17 wherein the second cable-clamping surface is substantially frusto-conical in shape.

21. The invention of claim 17 wherein the second head portion defines a cylinder diameter, and wherein the chamfer has a length that is greater that 1/20 of the diameter.

22. The invention of claim 17 wherein the first cable-clamping surface is separated from the second cable-clamping surface by a recess formed in the first head portion.

23. The invention of claim 17 wherein the first cable-clamping surface is radiused near the second head portion to reduce any tendency of the first cable-clamping surface to cut into the cable.

24. A device for clamping a cable comprising:

a first member comprising a first tail portion and a first head portion;

a second member comprising a second tail portion and a generally cylindrical second head portion received within the first head portion for rotation therein about a rotation axis;

said tail portions being spaced apart when said device is in an open, cable-receiving position and in close proximity when said device is in a closed, cable-clamping position;

said first head portion having a cable-receiving opening and said second head portion having a cable-receiving bore, said opening and bore being in general axial alignment when said device is open and in axial misalignment when said device is closed;

said device having a first cable-clamping surface comprising an interior surface portion of said opening and a second cable-clamping surface comprising an interior surface portion of one end of said bore;

said cylindrical head portion of the second member comprising a substantially cylindrical surface defining a cylinder diameter;

said second cable-clamping surface diverging from the cable-receiving bore in a region spaced from the cylindrical surface by more than about 1/20 and less than about 1/4 of the diameter;

said first cable-clamping surface being blunted near the second head portion at an inner edge of the first cable-clamping surface, thereby reducing any tendency of the first cable-clamping surface to cut into the cable when said device is moved to the closed, cable-damping position.

25. The invention of claim 24 wherein the region is spaced from the cylindrical surface by about 1/10 of the diameter.

26. The invention of claim 24 wherein the second cable-clamping surface is substantially frusto-conical in shape.

27. The invention of claim 24 wherein the first cable-clamping surface is separated from the second cable-clamping surface by a recess formed in the first head portion.

28. The invention of claim 24 wherein the second cable-clamping surface comprises a chamfer.

29. The invention of claim 24 wherein the first cable-clamping surface is radiused near the second head portion to reduce any tendency of the first cable-clamping surface to cut into the cable.

* * * * *

UNITED STATES PATENT AND TRADEMARK OFFICE

CERTIFICATE OF CORRECTION

PATENT NO. : 6,325,677 B1
DATED : December 4, 2001
INVENTOR(S) : Carl R. Tamm

It is certified that error appears in the above-identified patent and that said Letters Patent is hereby corrected as shown below:

Column 5,
Line 17, delete “damping” and substitute -- clamping -- in its place;
Line 19, delete “damping” and substitute -- clamping -- in its place;
Line 31, delete “damping” and substitute -- clamping -- in its place;
Line 33, delete “dosed, cable-damping” and substitute -- closed, cable-clamping -- in its place.

Signed and Sealed this

Twelfth Day of November, 2002

*Attest:*

*Attesting Officer*

JAMES E. ROGAN
*Director of the United States Patent and Trademark Office*